United States Patent [19]

Yamada

[11] 4,246,681

[45] Jan. 27, 1981

[54] METHOD FOR REMOVING FASTENER ELEMENTS FROM A SLIDE FASTENER CHAIN AND APPARATUS THEREFOR

[75] Inventor: Takehiko Yamada, Yao, Japan

[73] Assignee: Yoshida Kogyo K.K., Tokyo, Japan

[21] Appl. No.: 17,922

[22] Filed: Mar. 6, 1979

[30] Foreign Application Priority Data

Nov. 16, 1978 [JP] Japan ..... 53/141607

[51] Int. Cl.[3] ..... B23P 19/04

[52] U.S. Cl. ..... 29/426.4; 29/770; 29/426.5

[58] Field of Search ..... 29/770, 427, 414, 239, 29/408

[56] References Cited

U.S. PATENT DOCUMENTS

| | | | |
|---|---|---|---|
| 2,594,789 | 4/1952 | Morin | 29/770 |
| 3,863,323 | 2/1975 | Takamatsu | 29/770 |
| 3,958,319 | 5/1976 | Takamatsu | 29/427 |
| 4,062,100 | 12/1977 | Heimberger | 29/770 |

*Primary Examiner*—Milton S. Mehr

*Attorney, Agent, or Firm*—Hill, Van Santen, Steadman, Chiara & Simpson

[57] ABSTRACT

In the method of the invention, the slide fastener chain is firmly held by gripping the carrier tape at the very boundary with the lower end of the leg portion of the fastener element with a fixed gripper die jaw and a movable gripper die jaw and then the head portion of the fastener element is forcibly pressed toward the leg portion whereby the bifurcated leg portion is widened by the forcible thrusting of the blade edges of the die jaws into the interstices between the legs and the carrier tape with eventual dividing of the fastener element at the head portion into two pieces to come off the stringer core of the carrier tape easily.

5 Claims, 10 Drawing Figures

METHOD FOR REMOVING FASTENER ELEMENTS FROM A SLIDE FASTENER CHAIN AND APPARATUS THEREFOR

BACKGROUND OF THE INVENTION

The present invention relates to a method and apparatus for producing an element-free gap or a so-called space section in a continuous length slide fastener chain composed of a carrier tape and a row of discrete elements securely fastened to the carrier tape along one longitudinal edge peripherally around a stringer core reinforcing the tape edge as well as for removing some additional number of elements at the end of the element row of a slide fastener chain when cut in a product length, the elements being formed by die-casting a metal or injection-molding a synthetic plastic resin.

It is a usual practice nowadays of manufacturers of slide fasteners that, instead of manufacturing slide fasteners of individual product lengths as such, a continuous length slide fastener chain is first manufactured by securely fastening fastener elements, which have been shaped by die-casting a metal or injection-molding a plastic resin, on to the stringer core reinforcing the peripheral edge of the carrier tape to form an element row and then to form so-called space sections free of the elements by removing several elements at certain intervals followed by cutting the carrier tape within the space sections into the individual desired product lengths. Further there may often be a necessity to remove several of the fastener elements from a slide fastener of a finished product length to obtain a shortened slide fastener, for example, in tailors and other users as well as in a retailor's shop according to customer's order to match the slide fastener to the design or size of clothes or other products to which the slide fastener is to be sewn.

There have heretofore been proposed various methods and related apparatuses for the production of space sections in a continuous length slide fastener chain of the above type with the above-described purpose. One of the methods known in the art is concerned with cutting the coupling head portions of the elements only off the fastener chain within the desired section and thereafter removing the leg portions of the elements left in engagement with the stringer core off the carrier tape by pulling. Another method comprises the steps of pressing fastener elements in a space length as desired into deformed, flattened configuration and thereafter forcibly separating the thus deformed elements from the stringer core. These prior art methods, however, suffer from the drawbacks that the carrier tape or, especially, the stringer core is sometimes injured as well as that the removal of the fastener elements is sometimes incomplete because the methods involve the step of forcible plucking of the deformed elements or element debris from the stringer core.

In order to mitigate the above-described drawbacks in the prior art methods, an improved method and an apparatus have been proposed in U.S. Pat. No. 3,958,319, in which the fastener element is cut at the head portion thereof in the direction toward the stringer core and divided into two pieces readily removable by knocking off the stringer core. This method and the apparatus therefor, however, also cannot be free from certain problems to be improved as described below.

Namely, the cutter punch for cutting the fastener elements at the head portions thereof must be provided with a plurality of cutter blades at regular intervals corresponding to the pitch and the number of the elements to be removed within the range of the desired space length and, in addition, chain support members must be provided at the position between each pair of the adjacent cutter blades in order to grip and hold the stringer core in the knocking of the divided elements off the stringer core. Moreover, bifurcated spacer arms must be provided below the cutting punch to fix the elements at the position so as to facilitate cutting of the elements at the head portions thereof. Therefore, disadvantages are brought about by the necessity that the cutting punch, the chain support members and the spacer arms must have each an appropriate shape and size in accordance with the size and pitch of the fastener elements to be removed so that a set of these tools suitable for a fastener chain must be replaced with another set for working with another fastener chain having elements of different size and pitch.

Besides, the apparatus as a whole is relatively large so that inconvenience is unavoidable in handling the apparatus for the work of shortening slide fastener chains, for example, in a retailer's shop.

SUMMARY OF THE INVENTION

An object of the present invention is therefore to present a novel and improved method and apparatus for providing a space section in a continuous length slide fastener chain by removing certain number of the fastener elements within the section with which the work of making space sections in a slide fastener of any size can be performed very conveniently regardless of the size of the slide fastener without replacement of the die and punch in compliance with the size of the individual fastener chains thus eliminating the above-described drawbacks in the prior art methods and apparatuses.

Another object of the present invention is to present an apparatus for removing fastener elements off a slide fastener chain which is designed and constructed compactly and can be handled easily so as to be operated even by an unskilled person.

Still another object of the present invention is to present an apparatus for removing some additional number of the fastener elements from a slide fastener chain of a product length with a space section so as to obtain a fastener chain with a shortened element row.

The method of the present invention comprises the steps of gripping a carrier tape of a slide fastener chain at the boundary position adjacent to the leg portion of the fastener element, pressing the head portion of the fastener element toward the leg portion thereof so that the bifurcated element becomes widened at the leg portion to come off the stringer core of the carrier tape and dividing the element at the head portion into two pieces.

The apparatus of the present invention used for practicing the above method comprises a gripper die composed of a fixed die jaw and a movable die jaw, each of the die jaws being provided with a blade edge in the upper end thereof in an opposite position to the blade edge of the other die jaw, a means for bringing the movable die jaw close to and apart from the fixed die jaw relatively and a punch positioned above the gripper die and capable of moving vertically.

DETAILED DESCRIPTION OF THE PREFERRED EMBODIMENTS

Figure 1A:
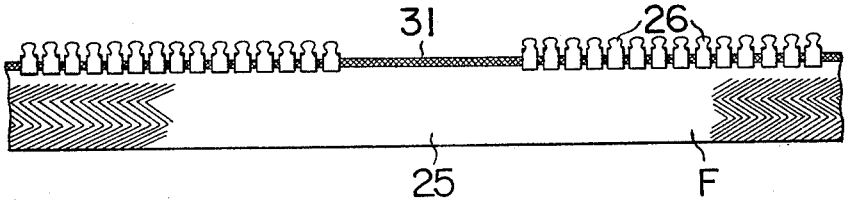
FIG. 1*a* is a plan view of a continuous length slide fastener chain provided with a space section obtained by a preferred method and a preferred apparatus in accordance with the present invention.
Figure 1B:
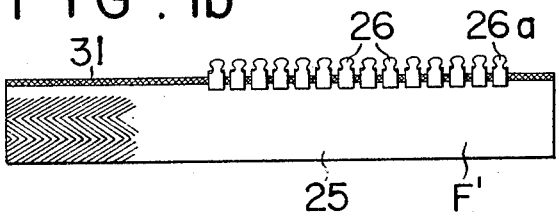
FIG. 1*b* is a plan view of a slide fastener chain as cut at the space section of the continuous length slide fastener chain shown in FIG. 1*a*.

In the drawings, FIG. 1*a* illustrates a continuous length slide fastener chain F finished in accordance with the present invention in which fastener elements 26 are securedly fixed to the stringer core of the carrier tape 25 originally in an uninterrupted row along the peripheral edge of the the carrier tape 25, from which several of the elements have been removed to form a space section 31 and FIG. 1*b* illustrates a fastener chain F' with a somewhat elongated space section 31 formed by removing some more elements from the fastener chain obtained by cutting the continuous length fastener chain F shown in FIG. 1*a*.

Figure 2:
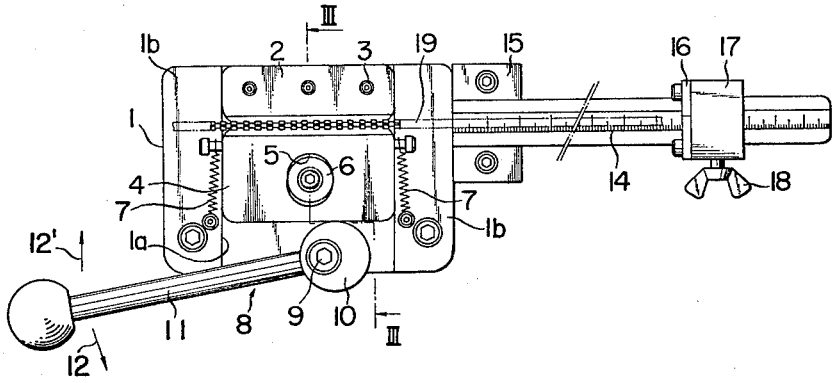
FIG. 2 is a plan view of the apparatus as an embodiment of the present invention.
Figure 3:
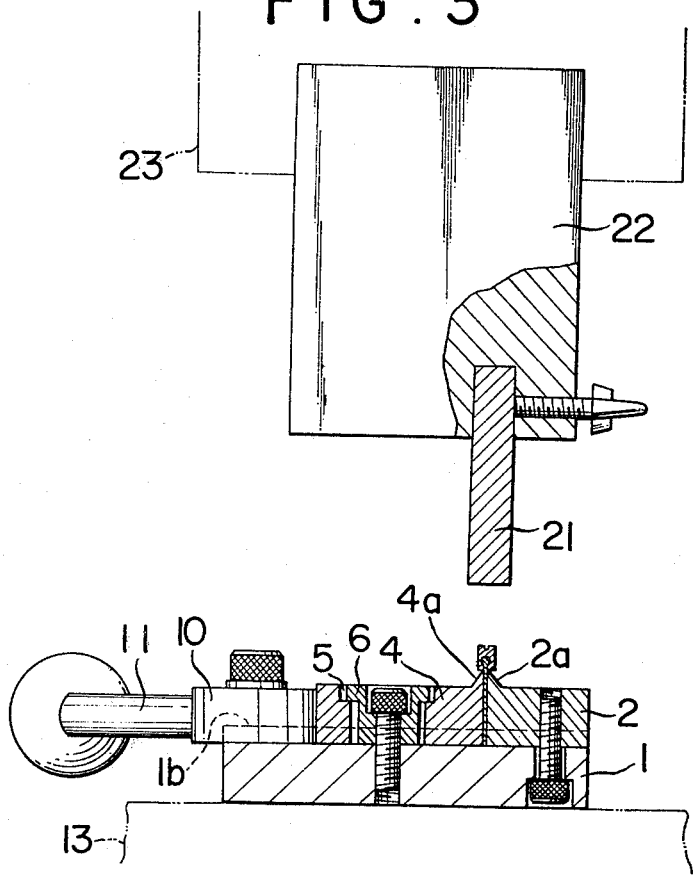
FIG. 3 is a cross sectional view of the apparatus shown in FIG. 2 as cut along the line III—III.

FIG. 2 is a plan view of the main part of the preferred apparatus with omission of the punching unit and FIG. 3 is a vertical cross sectional view of the apparatus as cut along the line III—III in FIG. 2, in which a die holder 1 is mounted on a die plate 13, a fixed die jaw 2 of a gripper die secured on the die holer is positioned in a stepped recess 1*a* between right and left cheeks 1*b*, 1*b* by means of bolts 3, and a movable die jaw 4 is positioned oppositely to the fixed die jaw 2 and is capable of sliding in the stepped recess 1*a* of the die holder 1 between the right and left cheeks 1*b*, 1*b* so as to be able to grip the slide fastener chain inserted into the gap between the fixed and movable die jaws 2 and 4 when the latter is brought close to the former. The movable die jaw 4 is provided with a guide hole 5 in which a guide bush 6 protruding from the die holer 1 is fitted with play. The movable die jaw 4 is always urged with tension springs 7, 7 in the direction apart from the fixed die jaw 2. The end surfaces of the fixed and movable die jaws 2 and 4 nearest to each other extend upwardly to form protruded blade edge 2*a* and 4*a* each having a cross section with an acute angle as shown in FIG. 3. The very tips 2*a*' and 4*a*' of the edged blades 2*a* and 4*a* are slightly chamfered so that the carrier tape of the slide fastener chain might not be injured by the edges 2*a*' and 4*a*' when the carrier tape is gripped by the fixed and movable die jaws 2 and 4.

The movable die jaw 4 is moved when pushed by an operating mechanism 8 toward the fixed die jaw 2 counteracting the pulling force of the springs 7, 7 and retracted by the springs 7, 7 when the operating mechanism 8 is released. The operating mechanism 8 is composed of an eccentric cam 10 pivotally fixed to the die holder 1 by a pivot 9 and a lever 11 connected to the eccentric cam 10 for revolving the same. When the lever 11 is pulled in the direction shown by the arrow 12, the movable die jaw 4 is pushed toward the fixed die jaw 2 so that a slide fastener chain inserted into the gap between both die jaws 2 and 4 is securely gripped whereas the fastener chain can be released by pushing the lever 11 in the direction shown by the arrow 12'.

At a lateral side of the above-mentioned die holder 1 is provided a scaled rod 14 as positioned along the line which is an extrapolation of the gap between the fixed and movable die jaws 2 and 4. An adjustable stopper holder 17 with a stopper surface 16 is mounted on the scaled rod 14 so as to be capable of sliding along the rod and capable of being fixed at a desired position by fastening with a screw 18. The surface of this scaled rod 14 may be at the same height as that of the cheek 1*b* of the die holder 1 but it is optional to provide a guide groove 19 in the cheek 1*b* of the die holder 1, the surface of the scaled rod 14 being approximately at the same height as the bottom line of this guide groove 19.

Above the die unit with the fixed and movable die jaws 2 and 4, a punching unit is provided composed of a punch 21 securedly fixed to a punch plate 23 through a punch holder 22 as is shown in FIG. 3. The punch plate 23 is capable of vertical movement up and down by operating a handle (not shown in the figure) or the like.

Figure 4:
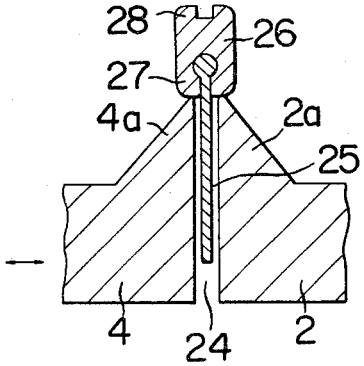

In the following, the steps of removing the fastener elements from a slide fastener chain are illustrated with reference to FIG. 4 to FIG. 7. First, the lever 11 is pushed in the direction shown by the arrow 12' to rotate the eccentric cam 10 so that the movable die jaw 4 is retracted apart from the fixed die jaw 2 by the pulling force of the springs 7, 7 to form a gap 24 between both die jaws 2 and 4 with a width sufficiently wide for insertion of the carrier tape 25 of the fastener chain F. The carrier tape 25 of the fastener chain F is inserted into this gap 24 with the row of the fastener elements 26 upside so that the row of the elements 26 is in contact with the edged blades 2*a* and 4*a* of the die jaws 2 and 4 at the lower end thereof as is shown in FIG. 4.

Figure 5:
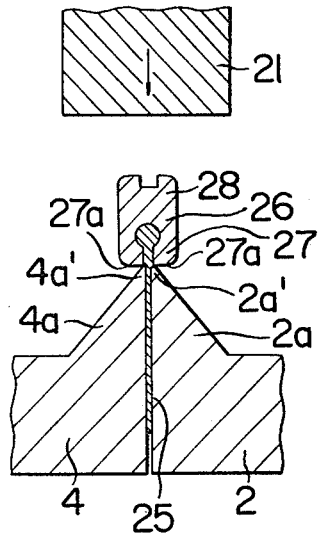
FIG. 4 to FIG. 7 are cross sectional elevational views of the main part of the apparatus illustrating the steps of removing the fastener elements according to the present invention.
Figure 6:
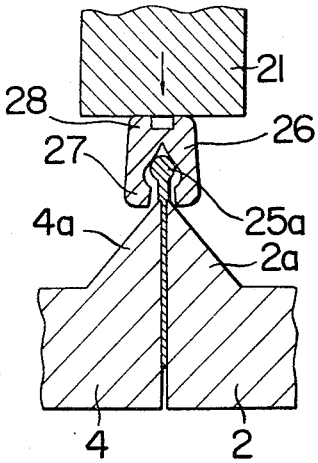
Figure 7:
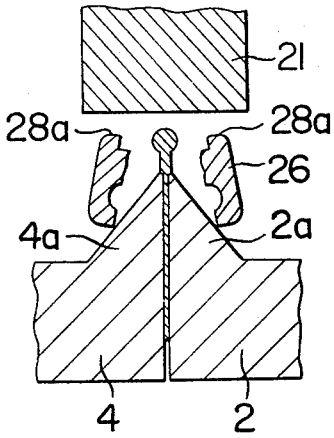

Thereafter the movable die jaw 4 is pushed toward the fixed die jaw 2 by pulling the lever 11 in the direction shown by the arrow 12 so that the fastener chain F in the gap 24 is firmly gripped by the die jaws 2 and 4 at the carrier tape 25 thereof as is shown in FIG. 5. In this manner, the elements 26 are secured by the die jaws 2 and 4 gripping the carrier tape 25 just below the lower ends 27*a*, 27*a* of the leg portions 27, 27 of the elements 26, i.e. at the boundary between the lower ends 27*a*, 27*a* of the elements 26 and the carrier tape 25 at the edged upper ends 2*a*' and 4*a*' of the protruded blade edges 2*a* and 4*a*. When the carrier tape 25 is pressed between the fixed and movable die jaws 2 and 4, the thickness of the carrier tape 25 is reduced a little so that the edges 2*a*' and 4*a*' of the edged blades 2*a* and 4*a* are thrust inwardly, though not significantly, from the interface between the lower ends 27*a*, 27*a* of the leg portions 27, 27 of the elements 26 and the carrier tape 25 as is shown in FIG. 5. This means a very marked facilitation of the wide-opening of the leg portions 27, 27 in the next step. Namely, the punch 21 is subsequently lowered to press down the elements 26 at the head portions 28 thereof whereby the elements 26 become widened at the leg portions 27, 27 thereof by the edges 2*a*' and 4*a*' of the edged blades 2*a* and 4*a* forcibly pushed between the bifurcated leg portions 27, 27 of the elements 26 and the carrier tape 25 so that the elements are freed from the stringer core 25*a* to which the elements 26 had been secured as is shown in FIG. 6. By further descending of the punch 21, the elements 26 become destroyed by cracking from the lower end (see FIG. 6) to the upper end 28*a* of the head portions 28 as is shown in FIG. 7 to be divided into two pieces readily removable off the stringer core 25*a* of the carrier tape 25.

The above described widening of the bifurcated leg portions 27, 27 of the elements 26 can be done with certainty even when the edges 2*a*' and 4*a*' are chamfered a little or rounded by wearing in prolonged service because the edges 2*a*' and 4*a*' are readily pushed into the interstices between the leg portions 27, 27 and the carrier tape 25 owing to the inward thrusting of the edged blades 2*a* and 4*a* from the inside surfaces of the leg portions 27, 27 as stated above.

Figure 8:
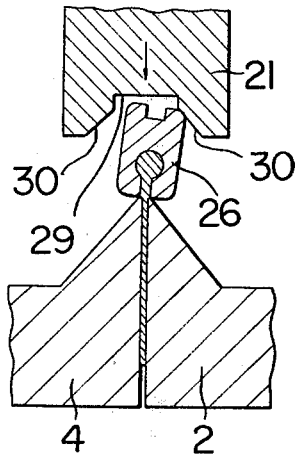
FIG. 8 and FIG. 9 are cross sectional views in the main part of an apparatus as an alternative embodiment of the present invention.
Figure 9:
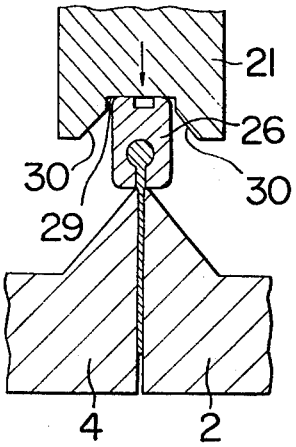

FIG. 8 and FIG. 9 illustrate another embodiment of the apparatus in which the punch 21 has a lower surface with a correction groove 29 for keeping the elements 26 in an upright disposition, the side walls 30, 30 of this correction groove 29 partly diverging so as to be wider at the lower ends so that even an inclined element 26 can fit into the correction groove 28 in an upright disposition as the punch 21 descends being guided by the sloped walls 30, 30 of the groove 29 whereby reliability in the widening of the leg portions 27, 27 of the elements 26 is ensured.

The slide fastener chain provided with a space section 31 by the preferred method and apparatus of the invention is shown in FIG. 1*a*, which is to be cut in the space section 31 into slide fastener chains of an individual product length. When a fastener chain of the product length as shown in FIG. 1*b* is to be further shortened with an extended space section by removing some more elements at the end of the element row as shown in the figure, the stopper holder 17 is fastened to the scaled rod 14 at an appropriate position and the element 26*a* at the rear end of the element row is brought into contact with the stopper 16 so that exact positioning of the chain is achieved. Thus the apparatus is applicable not only to the removal of elements from a continuous length fastener chain to form a space section as in FIG. 1*a* but also to the removal of some additional number of the elements from a fastener chain of a definite length obtained by cutting a continuous length fastener chain to elongate the space section as shown in FIG. 1*b* so that the apparatus can be used with its compactness and handiness even in a retailer's shop to comply with the customer's specific order for a shortened fastener chain.

In the method and apparatus as described above, the elements to be removed are forcibly widened at the leg portions to be destroyed into two pieces so that the removal of the elements from the stringer core can be performed with reliability and the stringer core is never injured since the stringer core receives no destructive force. In addition, no specific gripper means and punching means are necessitated since punching is performed upon the head portions of the elements while the elements are held at the position by the gripping of the carrier tape at the very boundary with the leg portions of the elements so that elements of any size can be efficiently removed without replacing the die and the punch regardless of the size of the elements.

What is claimed is:

1. A method of removing a fastener element from a slide fastener chain by dividing the fastener element forcibly into two pieces while the carrier tape of the fastener chain is firmly gripped at the boundary with the leg portion of the fastener element, characterized in that said dividing of the fastener element is effected by forcibly pressing the head portion of the fastener element toward the leg portion thereof whereby the bifurcated leg portion securely attached to the carrier tape is widened to come off the stringer core of the carrier tape until the fastener element is cracked at the head portion thereof into two pieces.

2. The method as claimed in claim 1 wherein the fastener element is held in an upright disposition during the step of forcibly pressing the head portion thereof toward the leg portion.

3. An apparatus for removing a fastener element from a slide fastener chain, comprising a gripper die composed of two oppositely positioned die jaws relatively movable toward each other for gripping the chain adjacent the elements thereon and each jaw having an edged blade adjacent said chain and extending toward said element, and a generally flat-surfaced punch movable against said element in a direction forcing the element against said blades to thereby crack the element.

4. The apparatus as claimed in claim 3 wherein the punch has a lower surface provided with a correction groove for keeping the fastener element in an upright disposition, the side walls of the correction groove diverging for guiding the fastener element.

5. The apparatus as claimed in claim 3, or claim 4 wherein a acaled rod is provided along the line which is an extrapolation of the gap formed between the edged blades of the die jaws.

* * * * *